United States Patent [19]

McDermott

[11] 3,965,589

[45] June 29, 1976

[54] IDENTIFICATION MEANS

[75] Inventor: Clifton Eugene McDermott, Salt Lake City, Utah

[73] Assignee: Bio-Logics Products, Inc., Salt Lake City, Utah

[22] Filed: Feb. 12, 1975

[21] Appl. No.: 549,426

[52] U.S. Cl. ..... 40/21 C
[51] Int. Cl.[2] ..... G09F 3/14
[58] Field of Search ..... 40/21, 20, 21 C, 10; 24/16, 17

[56] References Cited

UNITED STATES PATENTS

| | | | |
|---|---|---|---|
| 3,059,359 | 10/1962 | Goldammer | 40/21 C |
| 3,645,023 | 2/1972 | Larson | 40/21 C |
| 3,656,247 | 4/1972 | Bushnell | 40/21 C |
| 3,751,835 | 8/1973 | Smith | 40/21 C |

*Primary Examiner*—Louis G. Mancene
*Assistant Examiner*—Wenceslao J. Contreras
*Attorney, Agent, or Firm*—Criddle, Thorpe & Western

[57] ABSTRACT

A composite identification band having multiple identification indicia, the assembly of which comprises a strap with a lower pocket overlying an upper or exposed surface and opening at one end to receive a pressure-adhesive or any other type label adapted to have writing thereon; an upper pocket superimposed on said lower pocket and opening at both ends to receive and store an encoded identification plate. The upper surface of the upper pocket is partially folded back over a portion of said upper surface to form a pocket adapted to receive one or more pressure-adhesive indicia labels. An additional pocket, adapted to receive other indicia, is spaced in longitudinal alignment adjacent to said upper and lower pockets along the strap, an end of the strap nearest the upper and lower pockets contains a stud projecting upwardly from the underside and through the band. The other end of the strap contains a spaced series of holes adapted to fit over the stud when the band is looped or wrapped around the object to be identified. A tether, detachedly fastened to one side of the strap along a tear line, contains a hole which fits over the stud; and the other end of the tether contains a fastening mechanism, which, when the tether is looped through the encoded identification plate and the fastener is placed over the stud fixedly attaches to said stud. The composite band is, therefore, permanently attached to the object around which it is placed; and the tether and encoded identification plate are permanently attached to the strap.

7 Claims, 16 Drawing Figures

IDENTIFICATION MEANS

BRIEF DESCRIPTION OF THE INVENTION

1. Field of the Invention

This invention relates to means for identifying persons in places such as hospitals and rest-homes. More particularly this invention relates to a band which will allow identification of such persons, and which includes multiple means for displaying useful information concerning the person to be identified in such a manner that the information can be readily used.

2. Prior Art

The use of plastic identification bands in hospitals and similar places is well known. U.S. Pat. No. 3,059,359 discloses a bracelet, designed to permanently hold a patient's name and other relative data, fixedly attached to a patient's wrist. U.S. Pat. No. 3,467,246 shows similar bands and methods for mass production of them. Of more interest is U.S. Pat. No. 3,656,247, which discloses a band having two pockets, one of which is designed to hold a printed indicia card and the other holds, attached to a tether, an encoded identification plate from which other labels may be made.

SUMMARY OF THE INVENTION

The present invention is drawn to a novel identification band, which not only possesses all advantages taught by the abovementioned prior art, but also provides means for containing additional significant and often necessary data. In the normal day-to-day operation of a hospital, it is not at all uncommon to have patients who have special problems and/or allergies. For example, some patients are diabetics or hemophiliacs. Other patients are allergic to certain medications and drugs, such as penicillin which can cause adverse reactions and, in some cases, death. In larger hospitals, it is also possible that two patients will have the same or similar names. Moreover, in maternity cases, it is often necessary to attach three separate bands — two to the baby and one to the mother — to provide proper identification. These bands must, of course, be different sizes for the mother and the baby.

It is, therefore, an object of this invention to provide a composite identification band capable of containing multiple indicia.

It is also an object of this invention to provide a novel composite identification band capable of containing multiple indicia and also containing an encoded identification plate from which additional labels containing the same information on the plate can be made.

Other objects of this invention are to provide a novel pressure adhesive tape containing a backing and a method of inserting and securing said tape in an enclosed space or pocket while removing said backing, and to provide a positive, latching means for securing the composite identification until the latch means is destroyed during removal.

A still further object of this invention is to provide an identification system which will enable a newborn baby and mother to be identified without the use of a separate identification band for the mother.

Principal features of this invention include a composite identification band having multiple pockets each of which is adapted to contain information about the person to whom the band is attached. The band consists of a flexible plastic strap having a pocket end with exposed openings and male fastening means at the end thereof and a strap end having apertures adapted to be positioned over the male fastening means when the strap is looped around the wrist or ankle of the wearer. Preferably the pocket end of the bank is wider than the strap end. The pocket end is made of multiple layers of material with a lower pocket having an exposed opening and adapted to receive an identification label. Superimposed on the lower pocket and open at both ends is an upper pocket of a size to receive a plastic encoded identification plate attached to a tether. The top surface of said upper pocket is reversely folded over itself to partially overlap the upper pocket and has an exposed opening at one end. This small pocket may contain color coded adhesive backed labels to which different meanings can be assigned. A fourth pocket is located in longitudinal alignment adjacent to the other three pockets and extends in the direction of the strap end of the band. This pocket is primarily for maternity use and will contain identifying indicia conforming to indicia contained on identifying means placed on the newborn infant.

The identification band assembly is completed by means of the tether which is inserted through a transverse slot in one end of the encoded plastic identification plate. One end of the tether is placed over the male fastening means. The other end of the tether contains female fastening means which interlocks with the male fastening means securing the tether to the band and the band to the body of the wearer.

A further feature of the invention is a novel fastening means. The male portion has a relatively flat head with a circular shank projecting perpendicularly therefrom. The shank projects through the end of the band or other material to be fastened and has a first given diameter followed by a tapered shoulder to a second and smaller diameter. The shank ends with a head which has a lower surface projecting abruptly outwardly at a 90° angle from the smaller diameter of the shank and an upper surface which curves downwardly from the central top thereof to the outer periphery of the lower surface. The female fastening portion consists of an outer ring having four equidistantly spaced bars radiating inwardly from the lower surface thereof. The ring and inwardly space bars are centrally positioned over an aperture in the material to be fastened and the bars terminate at the outer periphery of the aperture. Attached to the bars are upward extensions. The upward extensions incline inwardly and are curved on the inside surface such that the space enclosed by these extensions is a circle of about the same diameter as the smaller shank of the male portion.

An annular ring extends downwardly from the terminal portions of the inwardly extending bars. The ring is continuous and is then, by appropriate means flared outwardly to form a continuous lip thereby securing the female fastening means to the material to be fastened.

The two fastening means are interlocked by bringing the underside of the female portion over the head of the shank. The upward extensions expand as they are forced over the shank head and then snap into position around the smaller diameter of the shank under the head.

Another feature of the invention is a label which is adapted to fit into a pocket, e.g., the lower pocket of the composite identification band. The label has multiple sections, (preferably three) which are separable from each other along transverse lines when the label is folded. The label has a continuous backing which has transverse score lines offset from but adjacent to the transverse label lines. When the label is folded along a transverse line the backing will fold along a score line leaving exposed the back of the label in the area between the transverse label line and the backing score line. The label may then be inserted into a pocket and held in place while the remainder of the backing is then peeled away leaving the label in the pocket. If desired the label may be adhesive backed.

An additional feature of the invention is a multiple maternity identification assembly consisting of two infant identification bands and an identification strip all of which are of flexible material, and joined together along parallel tear lines. The assembly has a pocket end section and a strap end section. The pocket opening is on the underside of the assembly at the junction of the pocket and strap sections. The pocket end contains a male fastening mechanism such as already described. The strap end contains apertures and terminates with a female fastening mechanism. The identification strip is divided into two or more sections by a transverse tear line or lines. The other line, if present, is about midpoint in the pocket sections. The two infant bands and the portion of the identification strip in the pocket end adjacent to the pocket opening are imprinted with the same identification indicia. Upon the birth of a baby the maternity assembly is separated along the parallel tear lines and the pocket section of the identification strip is separated from the end section or sections. A print, on a pressure sensitive label, is made from the encoded identification plate worn by the mother and inserted into the pocket sections of the infant bands and the center section of the identification strip. Using a ball point pen or other appropriate pointed means, the sex, time of birth and other pertinent information is written on the outside of the pockets and the writing is transferred onto the pressure sensitive label inside thus making such information a permanent part of the records contained in the pockets. The center section from the identification strip is inserted into the pocket adjacent to the overlaping pockets in the mother's band and the infant bands are looped around the arm and/or ankle of the infant until an appropriate aperture is secured over the male fastening means. The strap end is doubled back and the female fastening means is interlocked with its male counterpart.

These and other objects and features of the invention will become apparent from the following description, the accompanying drawings and the claims.

BRIEF DESCRIPTION OF THE INVENTION

In the Drawings:

FIG. 1, is a top plan view of a portion of a sheet of formed but unassembled composite identification bands, without identification indicia contained therein;

FIG. 2, a top plan view of one unassembled band without the identification indicia;

FIG. 3, a vertical sectional view of the band, taken along the line 3—3 of FIG. 2;

FIG. 4, a top plan view of the tether portion of the band;

FIG. 5, a vertical sectional view of the tether, taken along line 5—5 of FIG. 4;

FIG. 6, a perspective view of the assembled band, with the tether attached to the band and an identification plate attached to the tether and with other indicia means shown carried by the band;

FIG. 7, a perspective view of a typical plastic encoded tag attached to the tether;

FIG. 8, an enlarged, fragmentary sectional view of the fastening mechanism taken along line 8—8 of FIG. 6;

FIG. 9, a top plan view of an identification label, used with the band;

FIG. 10, a side elevation view of the label shown in FIG. 9 showing the score lines in both the identification tape and the backing attached thereto;

FIG. 11, a longitudinal cross-section view of the label as shown in view 10, but folded on a score line.

FIG. 12, a fragmentary cross-sectional view showing the insertion of the label as shown in FIG. 11 into a pocket, and showing how the backing can be peeled from the label;

FIG. 13, a top plan view of an unassembled maternity band embodiment of the invention;

FIG. 14, a vertical sectional view of the maternity band taken along line 14—14 of FIG. 13;

FIG. 15, a side sectional view of a maternity band taken along lines 15—15 of FIG. 13; and FIG. 16, a perspective view of the maternity band showing how it is fastened, and can be severed at the desired point.

DETAILED DESCRIPTION

Referring now to the Drawings

Figure 1:
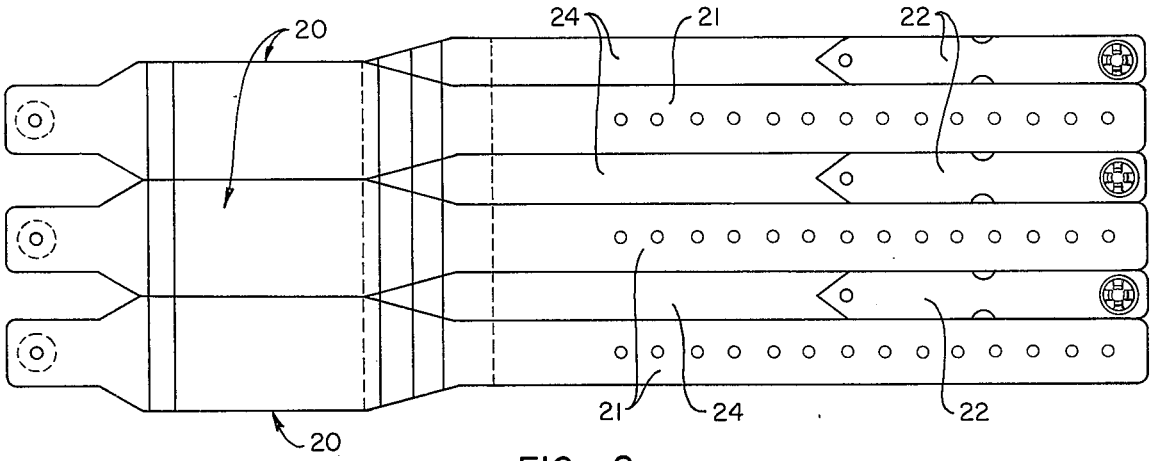

The composite identification band assembly is generally illustrated in FIGS. 1–8. A number of the bands are formed from overlying sheets of suitable, flexible, durable material and the parts of the band are separable along tear lines as illustrated in FIG. 1. Each composite band, shown generally at 20, comprises two main portions — the band portion designated as 21, and the tether portion designated as 22, (FIG. 2) and during assembly a small throw-away portion designated 24 is formed in the sheet material.

Figure 2:
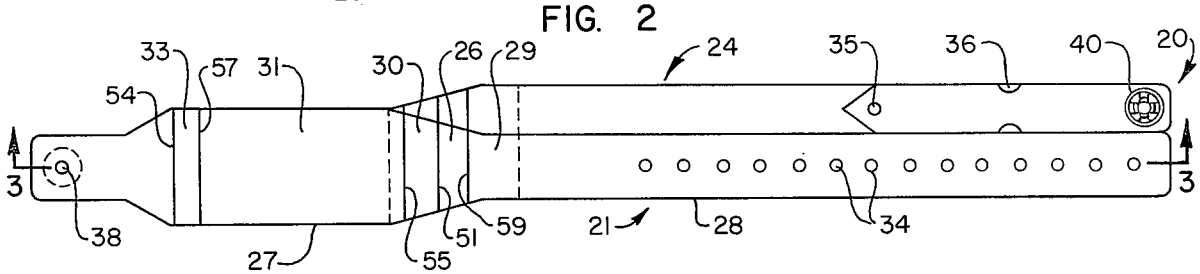

The bands are preferably constructed in the continuous fashion by scoring multiple plies of sheet material. A lower layer of flexible plastic material 25 (FIGS. 3 and 5), which may be of any desired color, is overlaid by a thin layer of relatively rigid vinyl material **25*a* which adds strength to the band and further aids in maintaining the form of the band. Layers 25 and 25*a* run the entire length of the band and have a relatively narrow central layer of plastic 26, superimposed over a portion of the band that joins a tag pocket end 27 to a strap end 28. A flexible layer 29, preferably of transparent plastic, overlaps a strap portion of the band from the end 28 thereof to a point overlapping the central layer 26, as shown best in FIG. 2. An additional layer of plastic 30 extends over the tag pocket end 27 from the end thereof to a point overlapping the central plastic layer 29. Superimposed over plastic layer 30 is an additional transparent layer of plastic 31 which extends primarily over the widest part of tag pocket and 27 (FIG. 2). Plastic layer 31 extends over a portion of plastic layer 26 but does not extend as far over layer 26 as does layer 30. At one end of 31, the plastic is reversely folded to form a layer 33, which partially overlaps 31 and adds to the strength of tag pocket end 27 as well as forming pocket 57 which may contain color coded tag alerts as will be detailed more fully hereinafter. During the production of the composite bands 20, layers are run continuously in a direction normal to the length of the bands, and the band portions are then formed by conventional cementing, heat sealing or other appropriate techniques into individual bands having a band portion 21, and a tether portion 22 and leaving a throw-away portion 24**. Score lines between adjacent sealing lines formed when the various plies are joined together to serve as tear lines to allow the parts of the band to be separated.

At the same time the various plies are being welded or otherwise fastened together, such as by heat sealing to form a band, other band forming operation may also occur. The holes 34 along the strap 28 and the holes 35 at the ends of the tether portion are formed by heat sealing and die cutting or other appropriate means. The indentations 36 in the tether portion are also formed or stamped out. Additionally hole 37 at the end of the band through which stud 38 is inserted is made, and the hole 39 for containing the female fastener 40 are also formed.

Any suitable plastic material or materials may be used for the layers making up the composite band. The vinyl plastics are particularly suitable, but other flexible plastics such as polyesters, polyalkylenes and the like may be used. The lower layer 25 and rigid layer 25*a* may be transparent or pigmented to any desired color such as white or orange. The other layers must, of necessity, be transparent; however, if desired, they may contain a matte-like finish.

The composite band 20 is prepared for use by inserting a stud 38 (FIGS. 3 and 8) into hole 37. The stud has a circular flat head portion 41 and a circular shank portion 42 that extends through the hole 37, and that has a length approximately corresponding to the thickness of the plastic layers 25, 25*a* and 30 which form the tag pocket end 27. An enlarged shank portion 43 extends from shank portion 42 to receive the width of the layers 25, 25*a* and 29 forming the strap portion 28 when the shank 43 is placed through one of the holes 34 and also to encompass the width of the layers 25 and 25*a* and 29 making up tether 22 when the shank 33 is placed through hole 35 at the end of the tether. A shoulder of the shank is tapered at an angle of about 15° from the elongate axis of the shank to a smaller shank position 45 and a head 36 is formed on the smaller shank portion. The head 46 has one surface 46*a* that extends abruptly outwardly at about a 90° angle from shank portion 45 for a short distance. Another surface 46*b* of the head 46 is carried from a central flat-top portion to the outer periphery of surface 46*a*. The female fastener 40 (FIGS. 4, 5 and 8) consists of a circular outer ring 47 having a diameter larger than the diameter of the hole 39. The ring 47 is positioned on one flat surface of the end of tether 22 and around the hole. Projecting radially inwardly from the lower portion of the ring 47 are four equidistantly spaced bars 48 which extend to about the periphery of hole 39. Projecting from the inner end of each of bars 48 are curved extensions 49*a* which extend upwardly from the bars 48 when the ring 47 is in a horizontal plane. Each upward extension 49*a* is inclined inwardly and the curved surface is such that the space enclosed by the equidistantly spaced extensions at the top is a circle of about the same diameter as the smaller shank portion 45. The upward extensions 49*a* terminate below the upper surface of ring 47. The annular ring 49*b* is adapted to be inserted through hole 39 and are then, by appropriate means, flared outwardly to form a continuous lip which secures the lower surface of ring 47 and bars 48 against the upper surface of tether 22.

Figure 3:
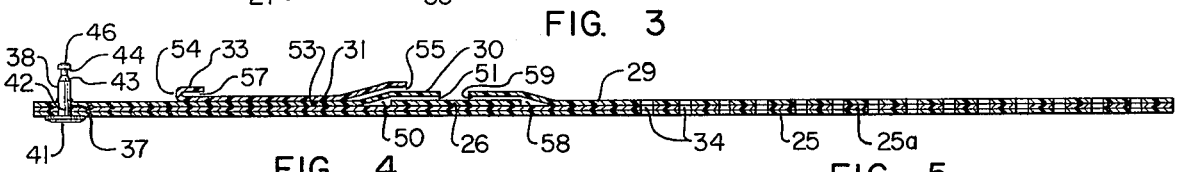
Figure 4:
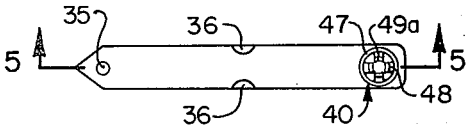
Figure 5:
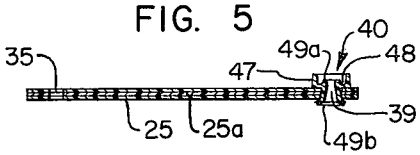
Figure 6:
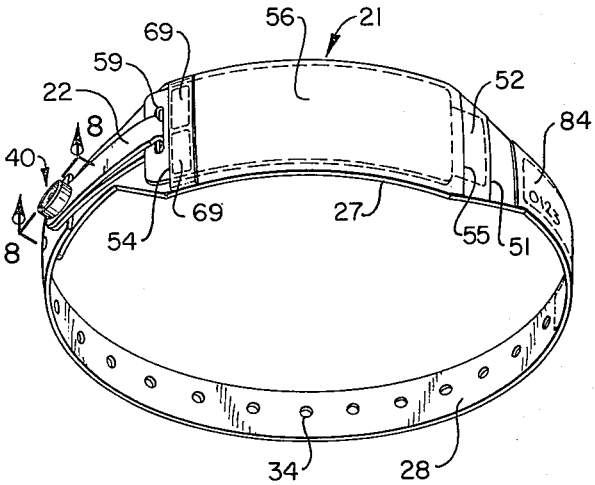

Each composite band 20, contains four separate pockets adapted to contain identification indicia (see FIGS. 2, 3 and 6). Pocket 50 having an opening 51 between plastic layers 26 and 30, is defined by the space between plactic layers 25*a* or 26, as the case may be, and layer 31. This pocket is adapted to contain a plain label or pressure adhesive 52, as will hereinafter be explained. Pocket 53 is defined by the space between plastic layers 30 and 31 and has openings 54 and 55 at either end. This pocket is designed to receive and hold an encoded identification plate 56 attached to tether 22 from which additional labels can be made without removing plate 56 from the tether, as will be hereinafter described. Pocket 57 is defined by the space between platic layer 31 and its foldedover portion 33. It is adapted to receive pressure adhesive labels 69, as will be explained hereinafter. Pocket 58, having an opening 59 between plastic layers 26 and 29, is defined by the space between plastic layers 25*a* or 26 as the case may be and layer 29 and is intended primarily for maternity use as will be explained later.

The composite band may be assembled in any preferred order. One method is to assemble by separating it from the bank of formed bands FIG. 2, along the tear lines and into its component parts, i.e., band portion 21 and tether portion 22. Band portion 21, containing all identification indicia, as will be hereinafter explained, is placed around the wrist or other body member of the person to be identified with the pocket portions forming the outer surface. The strap portion 28 is looped around the wrist or other body member until one of the holes 34 is in alignment with stud 38. The particular hole 34 selected will secure the band to the body member of the wearer, but not be so tight as to be uncomfortable. Selected hole 34 is then placed over stud 38. Tether 22 is placed through a transverse slot 59 in the encoded identification plate 56 (FIG. 7) so that the indentations 36 are in alignment with slot 59. Hole 35 in the end of tether 22 are placed over stud 38 and the other end of the tether containing the female fastener 40 is placed over the stud. The ends of tether 22 are placed over stud 38 in such a manner that the underside of the fastener 40 containing the downward extensions of 49*b* expand when forced over shank head 46 and then snap back into position under shank head 46 and around upper shank 45, thereby firmly locking both the tether 22 and band 21 firmly around the wrist or other body member of the wearer (FIG. 8).

Figure 7:
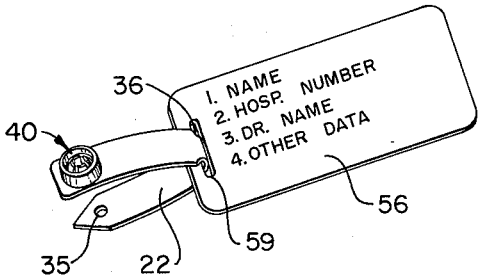
Figure 8:
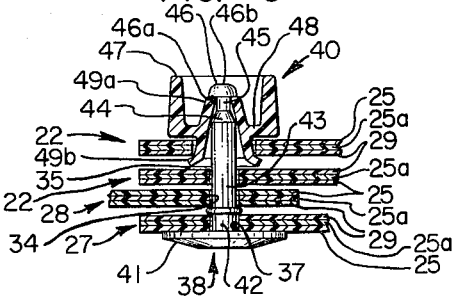
Figure 9:
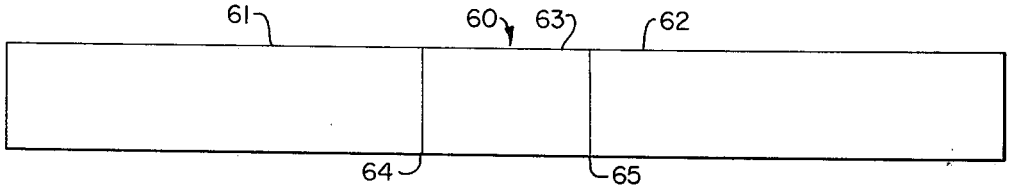

The encoded identification plate 46 as shown in FIG. 7 may be of any desired design, as long as said tag has a slot 59 in one end thereof through which the tether 22 may be inserted, and as long as said tag can be inserted through opening 54 into pocket 53.

Labels may be made from the encoded identification plate 56 in same manner as reproductions are made from present plastic or metal credit cards and the like. The plate 56 is inserted into an appropriate printing apparatus and the information in plate 56 may be transferred to a pressure sensitive label or sheet.

Figure 10:
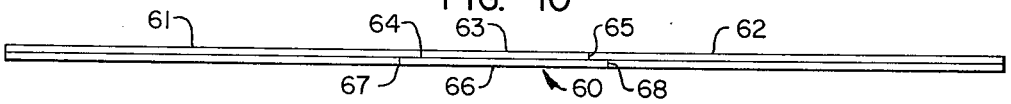
Figure 11:
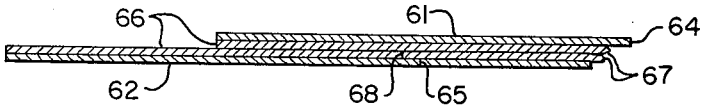

The labels, referred to as "allergy labels", to be inserted into pockets 50 and 57 are illustrated in FIGS. 9–12. These labels have many uses and may be made to any desired size. Label 60, shown in FIGS. 9 and 10, has three distince sections; label sections 61 and 62 which may or may not be identical and center section 63. These three sections may or may not be adhesive backed and are severed from each other along transverse lines 64 and 65. A full length protective backing 66 covers the back of label 60 and has score lines 67 and 68 running parallel to but offset from fold lines 64 and 65. The score lines 67 and 68 offset in the direction of and under label sections 61 and 62 as shown in FIG. 10 so that when label 60 is folded along fold lines 64, as shown in FIG. 11 the backing will break away from label section 61 at score line 67, thereby leaving the backing of label 61 from score line 67 to fold line 64 exposed.

The size of the label can or will be determinative of the function for which it is to be used. One or more small labels 69 positioned in a side-by-side relationship as shown in FIG. 6 may be inserted into pocket 57 and be color coded. A different meaning can be assigned to each color. A color may indicate that the person identified has special problems or conditions to which particular attention should be paid or is taking certain medications. For example, the color may be indicative of diabetes, hemophilia, hepatitis, epilepsy, heparin therapy, prior surgery requiring special treatment, or the like. Another color may indicate that there is another patient in the hospital having the same or similar name, so care should be taken to see that proper treatment is administered to the right patient.

The label illustrated in FIGS. 9–12 is designed for insertion into pocket 50, and will be designated as the "allergy" label. On this label may be printed or typed the known allergies a patient may have to various medications. For example, penicillin causes many people to break out in hives. Other medications can cause nausea, dizziness, shock and other serious side effects or adverse reactions. These allergies may by typed, printed or written on label sections 61 and 62. If desired, center section 63 may contain instructions for insertion of label section 61 into pocket 50. Label section 62 may then be placed on the patients chart or folder which is normally kept at a nurses station.

Figure 12:
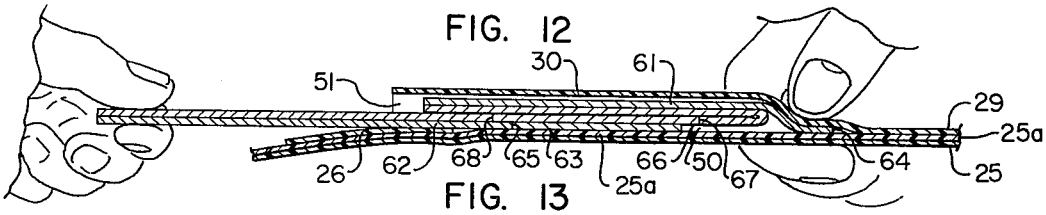

Label section 61 is inserted into pocket 50 as shown in FIG. 12. The label 60 is folded to the configuration shown in FIG. 11, and label section 61 is inserted into opening 51 between plastic layers 25*a* or 26 and 30. When label section 61 is completely inserted into pocket 50 pressure is applied (preferably by a finger) to that portion of label 61 between fold line 64 and score line 67 as illustrated in FIG. 12, thereby causing the exposed backing of label 61 at that point to be secured to plastic layer 25*a*. Label 60 is then gripped securely (preferably by fingers) at the outer end of label section 62 as shown and the backing 66 is removed or peeled from label section 61 by pulling outwardly on label section 62, while at the same time pressure is applied to label section 61 as already explained, thereby leaving label section inserted into pocket 50. If an adhesive backed label is used, as the protective backing 66 is removed from label section 61 contact is made between the adhesive on label section 61 and plastic layer 25*a*, thereby fixedly securing label section 61 into pocket 50. Since plastic layers 30, 31, and 33 are transparent, any writing on label section 61 is clearly visible when plate 56 is removed from pocket 53.

In the same manner, with smaller and more narrow labels, the color coded labels 69 may be inserted into pocket 57.

Figure 13:
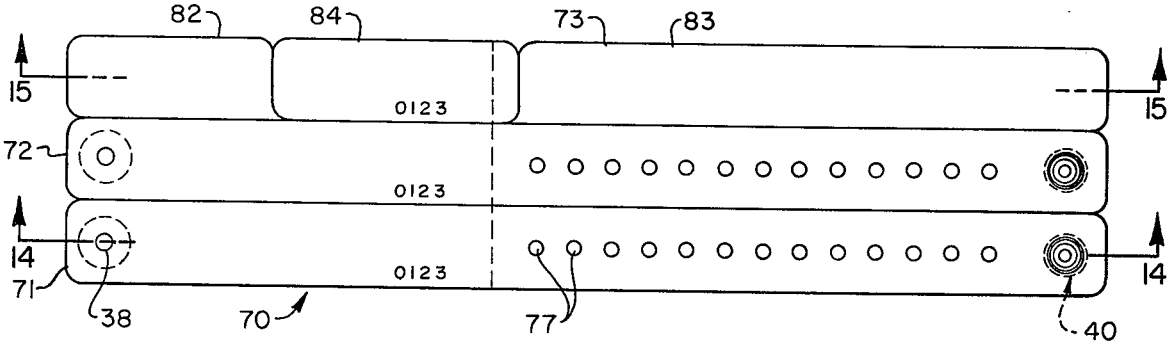

FIGS. 13–16 illustrate a maternity band as it applies to the present invention. A complete maternity band unit 70 is shown in FIG. 13 and comprises two identical infant bands 71 and 72 of a size to be worn around the ankle and wrist of a new-born infant and an identification strip 73.

Figure 14:
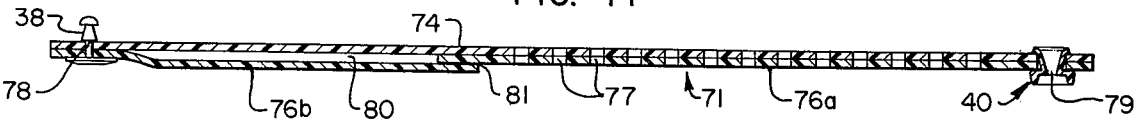
Figure 15:
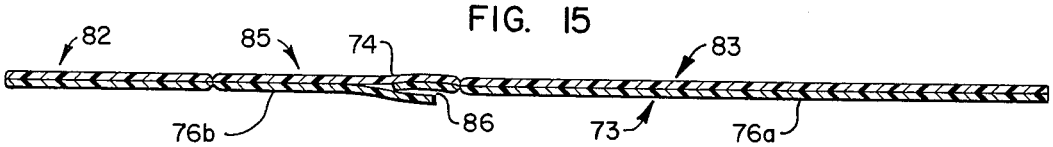
Figure 16:
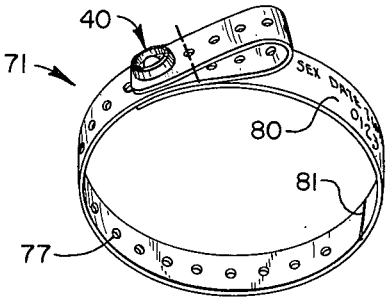

The maternity bands are made in continuous fashion by techniques explained earlier in this disclosure. Referring particularly to FIGS. 14 and 15, the band units 70, are each made up of two plies or layers of plastic. A top layer 74 is continuous and a bottom layer 75 is broken into two separate plies. On the bottom layer ply 76*a* is located at the strap end portion of the band and extends approximately two-thirds of the way across the length of band 70. The remaining plastic layer 76*b* is located on the pocket end of the band and extends to slightly overlap layer 76*a* on the underside thereof. It can thus be seen that by running three plies of plastic material in continuous fashion assembly 70 can be formed by heat sealing or welding the plies together in appropriate places. Each individual band or portion can be formed with the edges thereof sealed around the periphery and also tear lines from which one section of the band can be separated from the other can be formed. At the same time, the holes or apertures 77 in the infant bands and holes 78 and 79 which contain the fastening mechanisms can be formed by heat sealing or die cutting and sealing. When formed as described, bands 71 and 72 will contain a pocket 80 that is defined by layers 74 and 75 and will have an opening 81 on the bottom side of the bands, between overlapping layers 76*a* and 76*b*. Stud 38, as already described in reference to FIGS. 1–8, is inserted through hole 78 in the pocket end of the band. A female fastener 40, such as has already been described is inserted through hole 79 in the strap end of the band. The fastener 40 is inserted in an inverted position relative to the stud as shown in FIG. 14. Bands 70 and 71 are assembled as best illustrated in FIG. 16. The band is looped securely around the ankle and/or wrist of the newborn infant and an appropriate hole 77 is brought into alignment with the shank of stud 38 and is forced over the head of the shank. The end of the band containing female fastener 40 is then looped or doubled back over itself as shown in FIG. 16 and the downward extensions 49*a* are caused to expand over the shank head and then snap back into position around the upper end of the shank just below the shank head.

The identification strip 73 of assembly 71 is made up of two or three separate sections, as shown best in FIGS. 13 and 15. Sections 82 and 83 are disposable portions. During manufacture section 82 may be omitted. Tab section 84 contains a pocket 85 defined by plastic layer 84 on top and by layers 76*a* and 76*b* on the bottom (FIG. 15), and has an opening 86 between plastic layers 76*a* and 76*b*.

Each maternity band set 70 as manufactured, is imprinted with a common identification mark on band 71, 72 and tab section 84 (designated in FIG. 13 as 0123) which is different for each set. Prior to taking the mother to the delivery room labels are made on pressure sensitive material using plastic identification plate 56 attached to the mothers band 21. These labels are folded and inserted into pockets 80 in bands 71 and 72 (also pocket 85 if desired). The complete maternity band unit 70 is attached to the mother's chart and is taken with the expectant mother into the delivery room. Immediately after birth of the baby, the sex of the baby, date and time of birth are written on the outer surface of pocket 80, i.e., the upper plastic layer 74, with a ball point pen or other pointed object. This writing pressure transfers the information onto the pressure sensitive label contained in the pockets thereby making such information essentially permanent. Bands 71 and 72 are then placed around the wrist and ankles of the baby and the mother's tab section 84 is placed in pocket 58 of the mother's band 21. Mother and baby are then identified in two ways: (1) by the common identification mark or number contained on the maternity set, and (2) by the mother's data from plate 56 and sex, date and time of birth of the baby contained on labels in pockets 80 and 85. This system does not require different size bands for mother and baby as prior systems do, nor is the mother required to wear multiple bands.

Although preferred forms of my invention have been herein disclosed, it is to be understood that the present disclosure is made by way of example and that variations are possible without departing from the subject matter coming within the scope of the following claims, which subject matter I regard as my invention.

What is claimed is:

1. A composite identification band comprising:

a flexible plastic strap having located near one end thereof a lower pocket having an exposed opening at one end;

an upper pocket superimposed on said lower pocket having exposed openings at both ends;

a pocket partially overlying said upper pocket and open at one end;

a pocket longitudinally aligned with and adjacent to said upper and lower pockets along said strap having an exposed opening at one end;

male fastening means at the end of the strap containing said upper and lower pockets adapted to receive apertures in the other end of the strap in any of several possible positions when the band is in a looped condition;

a tether looped through a flat encoded identification plate, one end of the tether being adapted to fit over the male fastening means;

female fastening means carried by the other end of the tether adapted to interlock with said male fastening means when the ends of the tether are superimposed on each other thereby securing the strap in a looped condition and further securing the tether and encoded identification plate to said strap.

2. The composite identification band as claimed in claim 1 wherein the lower pocket contains a label having identification indicia thereon.

3. The composite identification band claimed in claim 2 wherein the identification plate is so sized and the tether is of sufficient length to permit the identification plate to be inserted into and stored in said upper pocket.

4. The composite identification band claimed in claim 3 wherein the pocket partially overlying the upper pocket contains one or more color coded indicia labels.

5. The composite identification band claimed in claim 3 wherein the pocket longitudinally adjacent to said upper and lower pockets contains additional identification indicia.

6. The composite identification band claimed in claim 1 wherein the exposed openings of the lower pocket and the pocket longitudinally adjacent thereto face each other.

7. The composite identification band claimed in claim 6 wherein the exposed open end of the upper pocket which is above the exposed opening of the lower pocket is offset therefrom so as not to overlap the opening in the lower pocket.

* * * * *